United States Patent [19]

Murphy et al.

[11] 4,360,938

[45] Nov. 30, 1982

[54] MACHINE FOR LASTING HEEL SEAT PORTIONS OF SHOES

[75] Inventors: Brian J. M. Murphy, Leicester; Leslie A. Withers, Barlestone; Malcolm Salway-Waller, Leicester, all of England

[73] Assignee: USM Corporation, Farmington, Conn.

[21] Appl. No.: 341,636

[22] Filed: Jan. 22, 1982

[30] Foreign Application Priority Data

Jan. 26, 1981 [GB] United Kingdom ..... 8102295

[51] Int. Cl.[3] ..... A43D 21/00

[52] U.S. Cl. ..... 12/12.5

[58] Field of Search ..... 12/12.4, 12.5, 7.8, 12/8.2, 8.7, 8.8, 10.5, 11.3

[56] References Cited

U.S. PATENT DOCUMENTS

| | | | |
|---|---|---|---|
| 3,087,176 | 4/1963 | Deschenes | 12/12.5 |
| 3,399,412 | 9/1968 | Allard | 12/12.5 |
| 3,444,571 | 5/1969 | Harriman | 12/12.5 |

*Primary Examiner*—Patrick D. Lawson

*Attorney, Agent, or Firm*—Donald N. Halgren

[57] ABSTRACT

In tack seat lasting machines, variation of the tack (nail) pattern is achieved by varying the wiper inwiping movement, itself dependent upon their lengthwise movement. Such variation also alters the "back tack" position (i.e. relationship between the heel band back-seam region and corresponding region of the wipers). In accordance with the invention, the nail pattern is varied by an operator-set reference potentiometer (198) by matching with its signal that of a linear potentiometer (190) which controls operation of wiper-operating motor (72, 74). The back tack position is controlled by a motor (105) according to an operator setting of a reference potentiometer (208). The combined signal from the reference potentiometers (198, 208) is compared with a control signal of a linear potentiometer (202) associated with the heel band, the motor (105) being operated until the compared signals match. Thus any variation of the nail pattern, by re-setting potentiometer (198), also causes motor (105) to operate to adjust the heel band position accordingly, thus maintaining the back tack position as set by the potentiometer (208).

7 Claims, 4 Drawing Figures

MACHINE FOR LASTING HEEL SEAT PORTIONS OF SHOES

BACKGROUND OF THE INVENTION (1) Field of the Invention

This invention is concerned with a machine for lasting heel seat portions of shoes. The word shoe, where used herein, is used generically as indicating articles of outer footwear generally, and as including such article in the course of its manufacture.

(2) Prior Art

There is described in our co-pending U.K. Patent Application Ser. No. 8020133 a machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for causing lasting marginal portions of the upper, at the heel seat region thereof, to be wiped over and pressed against corresponding marginal portions of the insole—said assembly comprising two wiper plates, first drive means for effecting movement of the wiper plates relative to the shoe bottom in a direction extending lengthwise of the shoe bottom, and cam means for effecting inwiping movement of the wiper plates, as lengthwise movement thereof is effected as aforesaid—and fastener inserting means by which, while the lasting marginal portions of the upper are being pressed against corresponding marginal portions of the insole as aforesaid, fasteners can be driven, through apertures formed in the wiper plates, adjacent leading edge portions of each thereof, thus to secure said marginal portions together, the machine also comprising second drive means for moving the heel band relative to the shoe support in a direction extending lengthwise of the shoe bottom.

In said machine, furthermore, the lengthwise movement of the wiper plates, in effecting a wiping operation, is limited by varying the position of one abutment member in relation to a co-operating abutment member, adjustment or control means being provided by which the operator can set the position to which the wiper plates are moved by the first drive means (constituting a fastener inserting position). By thus providing a facility for terminating the operation of the first drive means, the nail pattern provided by the wiper plates is readily adjusted, by a single adjustment, according to the contour of the shoe bottom to be operated upon.

In using the machine, furthermore, it has been found that, in certain instances, over a size range it is necessary merely to set the nail pattern according to the width of the shoe bottom in the vicinity of the leading edge of the wiper plates (the so-called "front tack" locality). Such setting, however, because it is dependent upon the lengthwise movement of the wiper plates, thus affects the position of the so-called back tacks, i.e. the tacks driven into the shoe bottom in the vicinity of the back seam region thereof. While it was considered, in the aforementioned specification, that variation in the "back tack" position by the setting of the nail pattern was acceptable, nevertheless it was also envisaged that in certain circumstances adjustment of the heel band position in relation to the wipers in a direction extending lengthwise of the shoe bottom would be desirable, and to this end the second drive means was operable under the control of the operator, for effecting adjusting movement of the heel band in this manner.

The provision of two separate adjustment means, however, for achieving adjustment of the nail pattern and adjustment of the heel band position is still considered time-consuming, and it is therefore the object of the present invention to provide an improved heel seat lasing machine in which variation of the nail pattern, by adjusting the fastener inserting position of the wiper plates, does not upset the relationship between the back seam region of the heel band and a corresponding region of the wiper plates.

BRIEF SUMMARY OF THE INVENTION

The invention thus provides a machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for causing lasting marginal portions of the upper, at the heel seat region thereof, to be wiped over and pressed against corresponding marginal portions of the insole—said assembly comprising two wiper plates, first drive means for effecting movement of the wiper plates relative to the shoe bottom in a direction extending lengthwise of the shoe bottom, and cam means for effecting inwiping movement of the wiper plates, as lengthwise movement thereof is effected as aforesaid—and fastener inserting means by which, while the lasting marginal portions of the upper are being pressed against corresponding marginal portions of the insole as aforesaid, fasteners can be driven, through apertures formed in the wiper plates, adjacent leading edge portions of each thereof, thus to secure said marginal portions together, the machine also comprising second drive means for moving the heel band relative to the shoe support in a direction extending lengthwise of the shoe bottom, and control means by which the operator can set the position to which the wiper plates are moved by the first drive means (constituting a fastener inserting position), the arrangement being such that the setting by the operator of the fastener inserting position of the wiper plates is effective to cause the second drive means to operate in such a manner that the relationship between the backseam region of the heel band and a corresponding region of the wiper plates is retained.

Thus, in using the machine in accordance with the invention, only a single adjustment is now required for varying the nail pattern, while ensuring that the back tack position, as determined by the relationship between the backseam region of the heel band and corresponding region of the wiper plates is maintained unaffected by such adjustment of the nail pattern.

The machine in accordance with the invention preferably also comprises further control means by which the operator can select the relationship between the backseam region of the heel band and corresponding region of the wiper plates, the arrangement being such that the setting of the fastener inserting position of the wiper plates as aforesaid causes said relationship as selected by the operator to be retained. In this way, the back tack position, that is to say the position on the shoe bottom at which the back tacks are driven thereinto, and more especially its relationship with the heel end of the shoe bottom, can be set by the operator, and the adjustment of the nail pattern as aforesaid will not interfere with the setting of the back tack position.

Conveniently, the first-mentioned control means comprises a signalling device, which is associated with the first drive means and which emits a control signal having a value varying proportionately with the lengthwise movement of the wiper plates, a reference signalling device which can be set by the operator and which emits a reference signal of fixed value, and a control circuit by which the value of the control signal can be compared with that of the reference signal, the control circuit being effective, when the value of the control signal matches that of the reference signal, to cause the operation of the first drive means to be terminated. Similarly, the further control means also may comprise a signalling device which is associated with the second drive means and which emits a control signal having a value varying proportionately with the movement of the heel band, and a reference signalling device which can be set by the operator and which emits a reference signal of fixed value. In such case, furthermore, the control circuit is effective to compare the value of the control signal with the combined value of the reference signals from the two reference signalling devices and to cause the second drive means to operate until said compared values match, whereupon such operation of the second drive means is terminated. In this way, whereas the first-mentioned control means simply controls the position of the wiper plates, in a direction extending lengthwise of the shoe bottom, the further control means takes into account not only the setting of the reference signalling device of said means, but also the setting of the reference signalling device of the first-mentioned control means so that, in response to a variation in the reference signalling device of the first-mentioned control means, the position of the heel band will be varied to maintain the relationship between the back tack position and the heel end of the shoe bottom, as set by the reference signalling device of the further control means.

In order to achieve the particular control circuit, conveniently a first power supply is provided by which the first-mentioned control means and also the signalling device of the further control means is supplied, and a separate power supply for the reference signalling device of the further control means.

Conveniently, each of the said signalling devices is constituted by a linear potentiometer, that of the first-mentioned control means being connected between a fixed head portion of the wiper assembly and a drive member of the first drive means, and that of the further control means being connected between a fixed frame portion of the machine and a mounting for the heel band, and also each of the reference signalling devices is constituted by a variable potentiometer which can be set by the operator. In addition, preferably the first drive means comprises a fluid pressure operated piston-and-cylinder arrangement and the second drive means an electric motor.

BRIEF DESCRIPTION OF THE DRAWINGS

There now follows a detailed description to be read with reference to the accompanying drawings of one machine in accordance with the invention. It will be appreciated that this machine has been selected for description merely by way of exemplification of the invention and not be way of limitation thereof.

In the accompanying drawings.

DESCRIPTION OF THE PREFERRED EMBODIMENT

Figure 1:
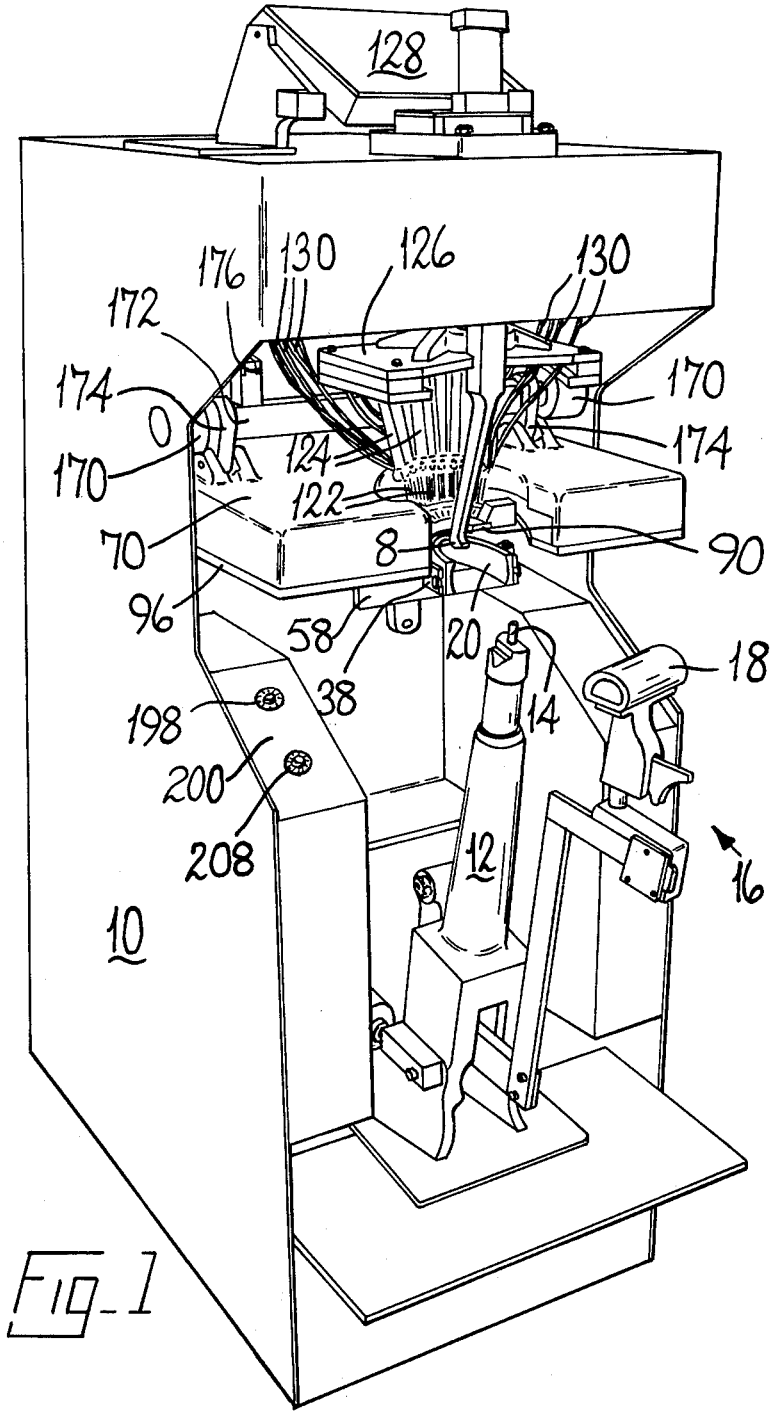
FIG. 1 is a front left-hand perspective of the machine in accordance with the invention.

The machine in accordance with the invention is a machine for lasting heel seat portions of shoes using tacks and shown in FIG. 1, and comprises a main frame 10 on which is supported, for pivotal movement about a horizontal axis, an upstanding shoe support 12 provided with a last pin 14 on which a last can be supported bottom uppermost. The last pin is capable of limited sideways movement on the shoe support. Also carried by the shoe support, for pivotal movement about an axis extending heightwise of the shoe support, is a toe support arrangement generally designated 16, including a toe pad 18 which is adjustable towards and away from the last pin 14, in order to accommodate different sizes of the shoe. A conventional holddown 8 is also provided.

Figure 3:
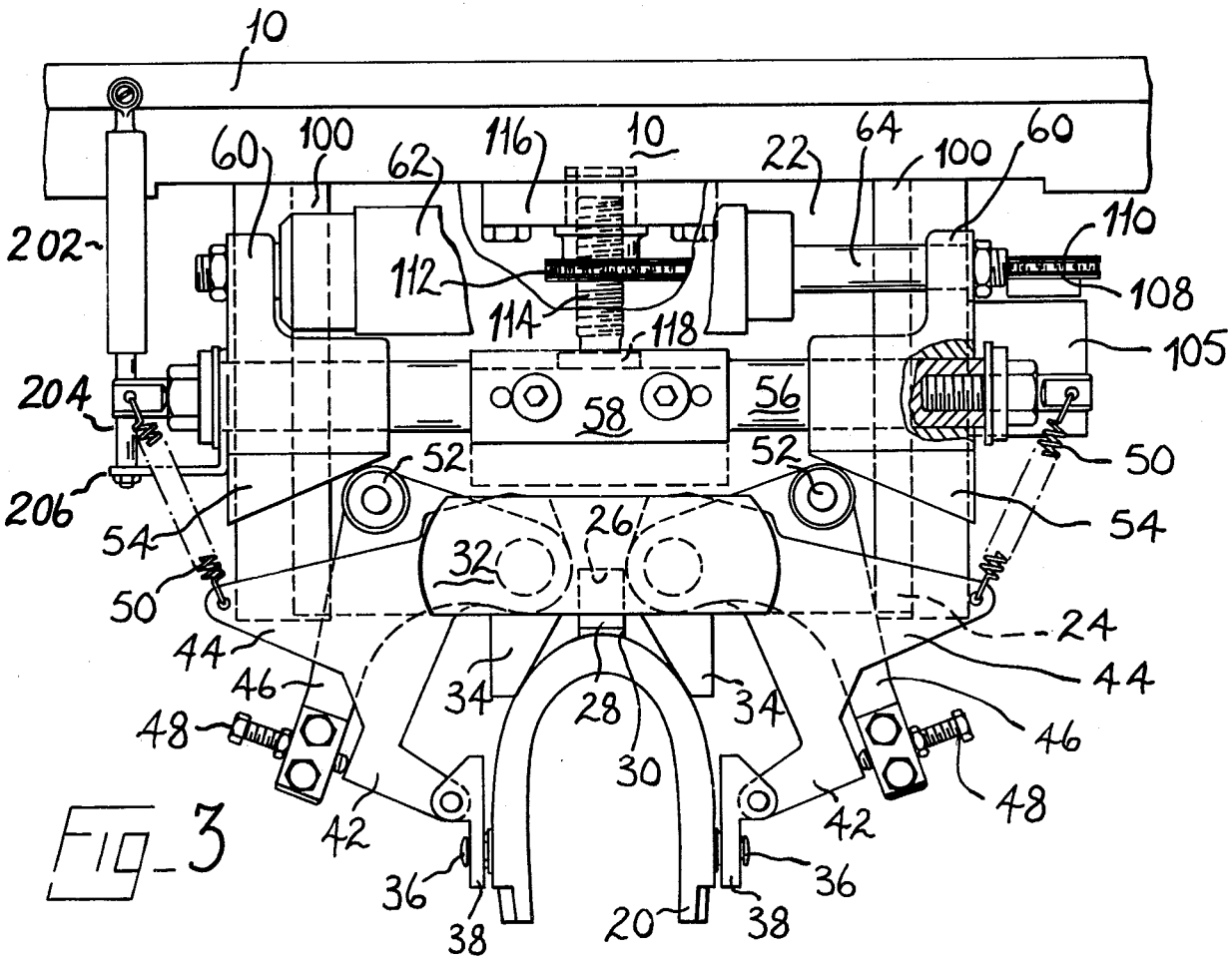
FIG. 3 is a fragmentary view showing a mounting for a heel band and actuating means therefor.

When a shoe has been loaded onto the shoe support 12, pivotal movement of the latter is effective to carry the shoe, heel end first, into an operating position determined by a heel band 20 supported in the machine frame 10 by an arrangement now to be described. Said arrangement thus comprises a support plate 22 (FIG. 3) having bolted thereto a plate 24 having a cut-away portion to form a recess 26 for receiving a tab 28 forming part of a support bracket 30 to which the heel band is secured, said band thus being supported in the machine. Secured to the plate 24, through spacers (not shown), is a further plate 32, there being welded to forward edges of said plates 24, 32 two lugs 34 provided with inclined faces against which portions of the heel band adjacent and at opposite sides of the backseam region thereof can abut when the heel band is supported as aforesaid, such inclined faces forming a generally V-shape.

For urging the "legs" of the heel band into clamping engagement with a shoe, each "leg" has a stud 36 received in an open-ended slot of a presser plate 38 which is pivotally supported, intermediate its length, on a projecting portion 42 of a lever 44. Each lever 44 is pivotally supported, between the plates 24, 32, on one of the spacers, said spacers being arranged on opposite sides of the recess 26. Also mounted on each spacer is a further lever 46 which carries an adjustable stop member 48 arranged to engage with a portion of its associated lever 44, a spring 50 being provided for urging the lever 44 against said stop member. Each lever 46 also carries a roll 52 engageable with an inclined face provided by a wedge member 54, the wedge members 54 being mounted for sliding movement, widthwise of the machine, on a rod 56 secured at its center in a block 58 carried by the support plate 22. Each wedge member 54 has a rearwardly extending lug 60, there being connected to one of said lugs a cylinder 62 of a piston-and-cylinder arrangement and to the other of said lugs a piston rod 64 of said arrangement. The arrangement is double-acting.

Figure 2:
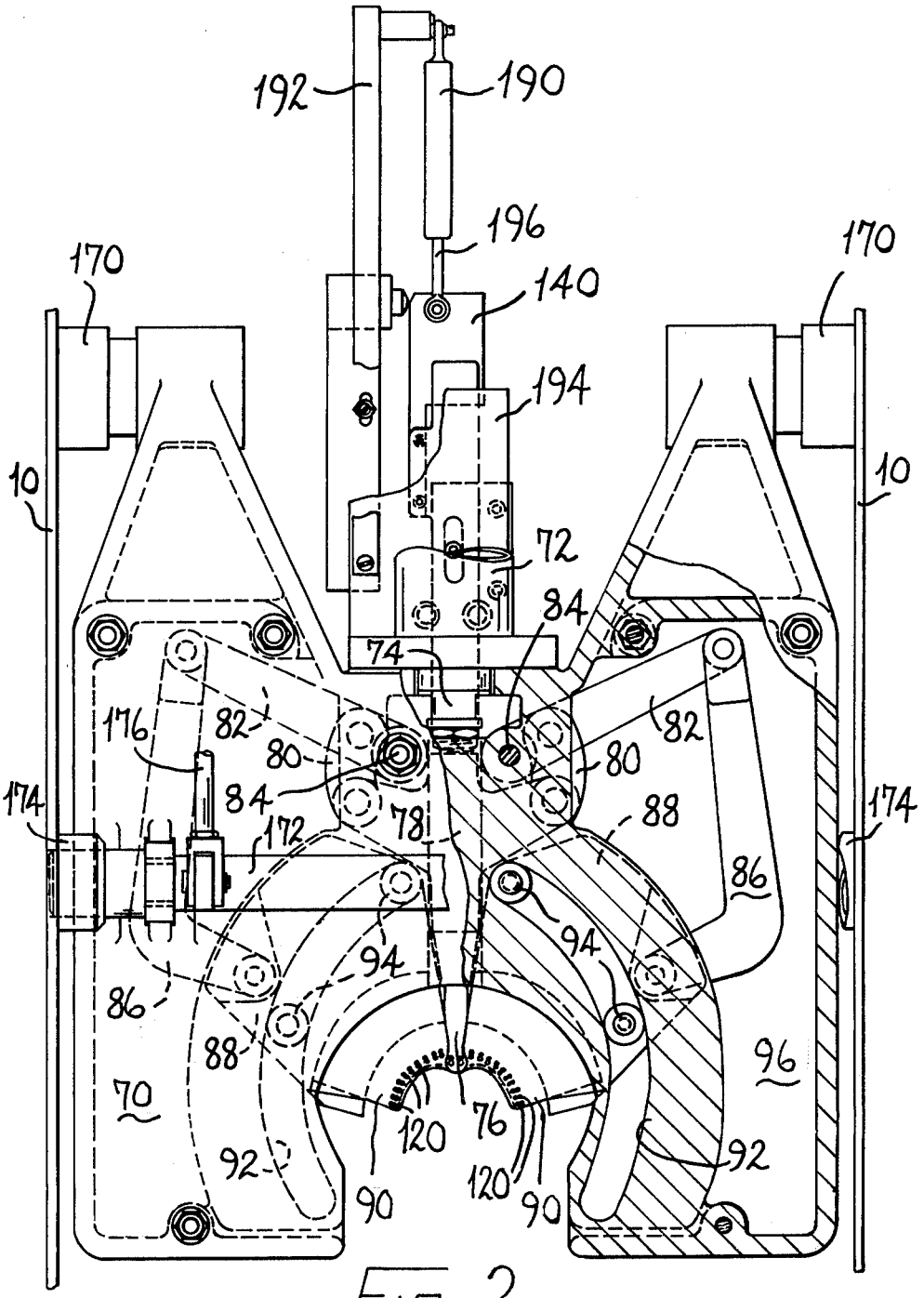
FIG. 2 is a fragmentary plan view showing details of a wiper assembly and of control means for controlling operation of fluid pressure operated means of said assembly.

The machine in accordance with the invention also comprises a wiper assembly by which lasting marginal portions of an upper can be wiped over and pressed against corresponding marginal portions of an insole of a shoe supported on the shoe support. The wiper assembly comprises a support casting 70, as shown in FIG. 2, on which is carried a cylinder 72 of a piston-and-cylinder arrangement a forwardly projecting piston rod 74 of which carries a central wiper portion 76 for movement towards and away from the last pin 14. The piston rod 74 further supports a cross-piece 78 to which two links 80 are operatively connected, one at each end, each link being pivotally connected to a lever 82 which is mounted for pivotal movement on a pivot pin 84 carried by the support casting 70. Thus, as the piston rod 74 is moved as aforesaid, the levers 82 are caused to pivot, each about its pivot pin. Pivotally connected to the end, remote from the pivot pin, of each lever 82 is one end of an L-shaped link 86, the other end of which is in turn pivotally connected to a wiper carrier 88, each wiper carrier supporting a wiper plate 90. The wiper plates 90 are arranged one at either side of the central wiper portion 76 and form therewith a continuous wiping surface, the arrangement being such that the wiper plates are moved radially relation to said portion 76 thus to effect an inwiping movement over the shoe bottom, as lengthwise movement under the action of the piston rod 74 takes place. To this end, there are formed in two upstanding bosses of the support casting 70 two radial slots 92, one associated with each wiper carrier, and further each wiper carrier 88 carries two rolls 94 accommodated in said slots. A bottom plate 96 is secured to the casting 70 to enclose the wiper carriers and hold them in position. Thus, as the levers 82 are caused to pivot as aforesaid, they effect, through the links 86, a corresponding movement of the wiper carriers 88, and thus of the wiper plates 90, along the radial slots 92.

For securing lasting marginal portions of an upper to corresponding marginal portions of an insole, using the machine in accordance with the invention, after said marginal portions have been pressed together as aforesaid, the wiper plates 90 and also the wiper portion 76 are provided with apertures 120 through which nails can be driven, the machine also comprising fastener inserting means for driving nails through said apertures. The fastener inserting means comprises a plurality of drivers 122, as shown in FIG. 1, accommodated in housing 124 therefor carried by the wiper carriers 88 and the central wiper portion 76. For actuating the drivers 122, a single fluid pressure operated hammer plate 126 is provided. In addition, nail separator means generally designated 128 is provided on the machine frame 10 and feeds nails one at a time via tubes 130 to the driver housings 124. The fastener inserting means of the machine is generally conventional.

The operation of the machine takes place in a generally conventional manner. Furthermore, for applying bedding pressure to the shoe bottom through the wiper plates 90, after the lengthwise and inwiping movement thereof is arrested, the support casting 70 is mounted, for pivotal movement about a horizontal axis, in two bearing blocks 170 (FIGS. 1 and 2) carried by the main frame 10, the casting being supported, at an intermediate position, by a rod 172 accommodated in bearings 174 formed on the casting. The rod 172 is mounted for rotation, about an axis eccentric of its center, under the action of fluid pressure operated means (not shown) acting through a push-rod 176, rotation of the rod 172 being effective to urge the casting, and thus the wiper plates 90 and wiper portion 76 against the shoe bottom.

As is conventional in tack seat lasting machines, the wiper plates 90 may also be heated, thus it improve the inwiping and pressing action of the wiper plates. To this end, cartridge heaters (not shown) are mounted in the wiper assembly. It has furthermore been found that, where enhanced heating of the wiper plates is provided, the amount of bedding pressure required to be applied can be reduced, and in such circumstances the rod 172 may be dispensed with and be replaced by two downwardly acting piston-and-cylinder arrangements (not shown).

In using the machine in accordance with the invention, it may be desired, for a given position of the wiper plates 90, to vary the fore-and-aft position of the heel band 20 relative to the wiper assembly, thus in fact varying the relationship between the backseam region of the heel band and corresponding region of the wiper plates 90, and thus the back tack position. To this end, the support plate 22 is carried in slideways 100 secured on the main frame 10 of the machine, for sliding movement therein, an electric motor 105 being mounted on one of the slideways and having connected to its output drive shaft a sprocket 108 connected by a chain 110 to a further sprocket 112 carried by a shaft 114 which is threadedly received in, and projects forwardly from, a block 116 secured to the main frame 10. A forward end of the shaft 114 is held captive in a block 118 secured to the up-side of the block 58. Thus, operation of the motor 105 is effective, through the sprockets and chain, to cause the block 58, and thus the heel band 20, to be moved forwardly and rearwardly along the slideways 100.

The piston-and-cylinder arrangement 72, 74 constitute first drive means of the machine in accordance with the invention, and the electric motor 105 second drive means thereof.

The machine in accordance with the invention also comprises control means by which the operator can set the position to which the wiper plates are moved by the piston-and-cylinder arrangement 72, 74 (constituting a fastener inserting position). To this end, the control means comprises a signalling device, in the form of a linear potentiometer 190, which is carried on a bracket 192 secured on a plate 194 carried by the support plates 70. The linear potentiometer 190 has a plunger 196 which is connected to a support bar 140 which is secured to the piston rod 74 and extends rearwardly and beneath the piston-and-cylinder arrangement 72, 74. Thus, movement in a lengthwise direction of the wiper plates 90 under the action of piston-and-cylinder arrangements 72, 74 is effective to cause the value of a control signal emitted by the linear potentiometer 190 to vary proportionately with the movement of the wiper plates 90. The control means also comprises a reference potentiometer 198 mounted on a control panel 200 of the machine, which potentiometer can be set by the operator and emits a signal of fixed value. As will hereinafter be seen with reference to FIG. 4, the control circuit of the machine compares the signals from the potentiometers 190, 198 and is effective to terminate operation of the piston-and-cylinder arrangements 72, 74 when the signals match one another. It will of course be appreciated that controlling the amount of lengthwise movement of the wiper plates 90 is effective to vary the nail pattern, in that the inwiping movement of the wiper plates 90 is conditional upon the amount of lengthwise movement thereof.

Similarly, a linear potentiometer 202 is carried on part of the main frame 10 of the machine and its plunger 204 is connected to a bracket 206 carried by the rod 56 of the arrangement by which the heel band 20 is supported. The linear potentiometer 202 forms part of further control means of the machine, said means also comprising a reference potentiometer 208 on the control panel 200 of the machine. The reference potentiometer 208 can be set by the operator in order to adjust the relationship between the backseam region of the heel band 20 and corresponding region of the wiper plates 90, thus setting the back tack position.

Figure 4:
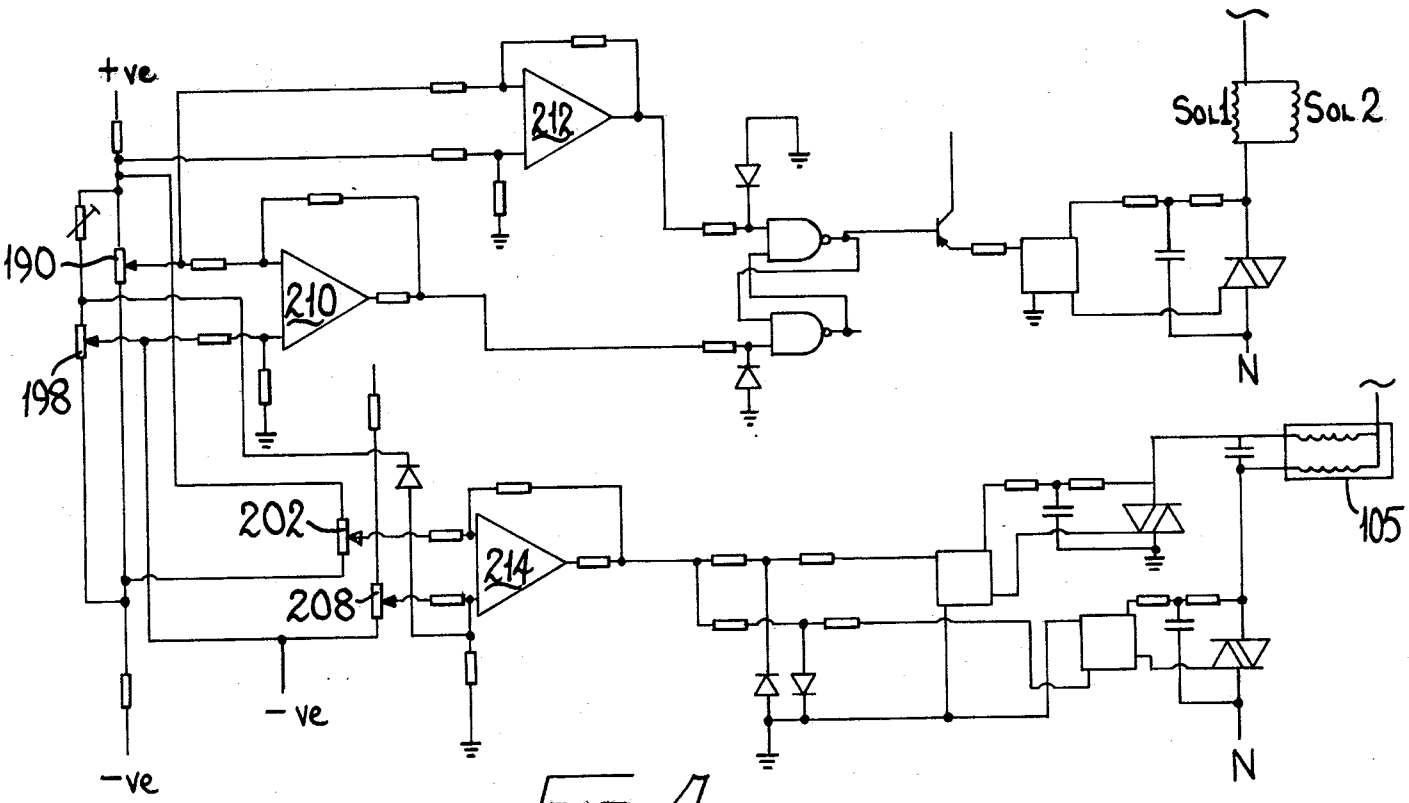
FIG. 4 is a diagram of a control circuit of control means of the machine.

Referring now to FIG. 4 it will be seen that the linear potentiometer 190 supplies a signal to a first operating amplifier 210 and also its reference potentiometer 198 supplies a signal to said amplifier, the arrangement being such that, while the two signals are not matching, an operating signal is provided through a drive circuit to a first solenoid SOL1 which supplies pressure fluid to the piston-and-cylinder arrangement 72, 74. When the signals are matched, the operating signal is terminated and the solenoid SOL1 de-energized. In this way, operation of the piston-and-cylinder arrangement 72, 74 is terminated, with the wiper plates 90 in their set fastener inserting position. In passing, a second operating amplifier 212 is provided in the circuit, receiving a direct signal from the power supply and also a signal from the linear potentiometer 190. This amplifier also supplies an operating signal through drive circuitry, which operating signal serves to energize solenoid SOL2 which allows return pressure fluid to the piston-and-cylinder arrangement 72, 74. By this arrangement, it is ensured that the wiper plates 90 are always returned to their initial condition, which is determined by a matching of the two signals fed to the amplifier 212, this occurring only when the value of the control signal of the linear potentiometer 190 matches the full power supply.

A third operating amplifier 214 is also provided, which receives a control signal from the linear potentiometer 202 and also a reference signal from the reference potentiometer 198, via the reference potentiometer 208, this latter potentiometer also providing a further reference signal from an independent power supply. Thus, the reference signal received by the operating amplifier 214 is the sum of the reference signals from the two reference potentiometers 198, 208. In this case, when the signal from the potentiometer 202 does not match the combined signals from the potentiometers 198, 208, an operating signal is supplied, through drive circuitry, to the electric motor 105, which motor continues to operate until the signals are matching, whereupon operation of the motor is terminated. It will thus be appreciated that the setting of the linear potentiometer 208, through its independent power supply, controls the back tack position, but in the event of the nail pattern being adjusted, by re-setting the reference potentiometer 198, this re-setting also affects the balance of the signals supplied to the operating amplifier 214, with the result that the motor 105 is caused to operate until the control signal emitted by the linear potentiometer 202 is again in balance with, i.e. matches, the combined signals from the potentiometers 198, 208.

In this way, therefore, it will be appreciated that, by a single adjustment (viz. of the reference potentiometer 198), the nail pattern can be adjusted, but without affecting the relationship between the backseam region of the heel band 20 and corresponding regions of the wiper plates 90, i.e. the back tack position. The reference potentiometer 208, on the other hand, is merely used when it is desired to vary the back tack position, and indeed the whole nail pattern position, lengthwise relative to the shoe bottom, e.g. when a new style of shoe is to be operated upon.

We claim:

1. A machine for lasting heel seat portions of shoes, comprising a shoe support for supporting, bottom uppermost, a shoe comprising an upper carried on a last and an insole held against the last bottom, a heel band for clampingly engaging the heel end of a shoe supported by the shoe support, a wiper assembly for causing lasting marginal portions of the upper, at the heel seat region thereof, to be wiped over and pressed against corresponding marginal portions of the insole—said assembly comprising two wiper plates, first drive means for effecting movement of the wiper plates relative to the shoe bottom in a direction extending lengthwise of the shoe bottom, and cam means for effecting inwiping movement of the wiper plates, as lengthwise movement thereof is effected as aforesaid—and fastener inserting means by which, while the lasting marginal portions of the upper are being pressed against corresponding marginal portions of the insole as aforesaid, fasteners can be driven, through apertures formed in the wiper plates, adjacent leading edge portions of each thereof, thus to secure said marginal portions together;

said machine also comprising second drive means for moving the heel band relative to the shoe support in a direction extending lengthwise of the shoe bottom, and control means by which the operator can set the position to which the wiper plates are moved by the first drive means (constituting a fastener inserting position), the arrangement being such that the setting by the operator of the fastener inserting position of the wiper plates is effective to cause the second drive means to operate in such a manner that the relationship between the backseam region of the heel band and a corresponding region of the wiper plates is retained.

2. A machine according to claim 1 wherein further control means is provided by which the operator can select the relationship between the backseam region of the heel band and corresponding region of the wiper plates, the arrangement being such that the setting of the fastener inserting position of the wiper plates as aforesaid causes said relationship as selected by the operator to be retained.

3. A machine according to claim 2 wherein the control means comprises a signalling device, which is associated with the first drive means and which emits a control signal having a value varying proportionately with the lengthwise movement of the wiper plates, a reference signalling device which can be set by the operator and which emits a reference signal of fixed value, and a control circuit by which the value of the control signal can be compared with that of the reference signal, the control circuit being effective, when the value of the control signal matches that of the reference signal, to cause the operation of the first drive means to be terminated.

4. A machine according to claim 3 wherein the further control means also comprises a signalling device, which is associated with the second drive means and which emits a control signal having a value varying proportionately with the movement of the heel band, and a reference signalling device which can be set by the operator and which emits a reference signal of fixed value, and wherein the control circuit is effective to compare the value of the control signal with the combined value of the reference signals from the two reference signalling devices and to cause the second drive means to operate until said compared values match, whereupon such operation of the second drive means is terminated.

5. A machine according to claim 4 wherein the reference signalling device of the further control means has a separate power supply from that of the control means and of the signalling device of the further control means.

6. A machine according to claim 5 wherein each of the said signalling devices is constituted by a linear potentiometer, that of the first-mentioned control means being connected between a fixed head portion of the wiper assembly and a drive member of the first drive means, and that of the further control means being connected between a fixed frame portion of the machine and a mounting for the heel clamp, and also each of the reference signalling devices is constituted by a variable potentiometer which can be set by the operator.

7. A machine according to claim 6 wherein the first drive means comprises a fluid pressure operated piston-and-cylinder arrangement and the second drive means an electric motor.

* * * * *